US011725876B2

(12) United States Patent
Wolf et al.

(10) Patent No.: US 11,725,876 B2
(45) Date of Patent: Aug. 15, 2023

(54) MODULAR, PORTABLE COLD ROOM STORAGE SYSTEM

(71) Applicant: RASP, LLC, New York, NY (US)

(72) Inventors: Jerrol Lee Wolf, New York, NY (US); Bruce Harvey Rubin, Lansdale, PA (US)

(73) Assignee: RASP, LLC, New York, NY (US)

( * ) Notice: Subject to any disclaimer, the term of this patent is extended or adjusted under 35 U.S.C. 154(b) by 89 days.

(21) Appl. No.: 16/999,337

(22) Filed: Aug. 21, 2020

(65) Prior Publication Data

US 2021/0095917 A1 Apr. 1, 2021

Related U.S. Application Data

(60) Provisional application No. 62/889,793, filed on Aug. 21, 2019.

(51) Int. Cl.
*F25D 29/00* (2006.01)
*F25D 11/00* (2006.01)

(52) U.S. Cl.
CPC ..... *F25D 29/003* (2013.01); *F25D 11/003* (2013.01); *F25D 29/005* (2013.01); *F25D 2323/0011* (2013.01); *F25D 2400/12* (2013.01)

(58) Field of Classification Search
CPC .... F25D 29/003; F25D 11/003; F25D 29/005; F25D 2323/0011; F25D 2400/12; F25D 29/00; F25B 27/002
See application file for complete search history.

(56) References Cited

U.S. PATENT DOCUMENTS 8,763,346 B2 * 7/2014 Kuster et al. ..... E04B 1/00 52/747
9,281,777 B1 * 3/2016 Borgstrom ..... H02S 20/00
9,523,517 B2 * 12/2016 Warpup et al. ..... F24J 2/5245
2010/0275810 A1 * 11/2010 Barbee et al. ..... B61C 3/00 105/50
2016/0280040 A1 * 9/2016 Connell et al. ..... B60H 1/00
2017/0146287 A1 * 5/2017 Rezayat ..... F25D 29/00
2019/0249913 A1 * 8/2019 Gongate et al. ..... F25B 49/02

FOREIGN PATENT DOCUMENTS

CN 101317048 A * 12/2008 ..... F25B 27/002
WO WO-2015116911 A1 * 8/2015 ..... H02S 20/00

OTHER PUBLICATIONS

CN-101317048—A Translation.*

* cited by examiner

*Primary Examiner* — Elizabeth J Martin
*Assistant Examiner* — Dario Antonio Deleon
(74) *Attorney, Agent, or Firm* — Katten Muchin Rosenman LLP

(57) ABSTRACT

A portable cold room storage system that includes an improved solar panel racking system is provided. The portable cold room storage system provides solar power for the cold room storage system. The portable cold room storage system includes a cold or cool room, one or more power sources to generate energy, a battery storage to store the energy generated by the one or more power sources and to supply the energy to the cold or cool room, and a racking system to mount the one or more power sources.

20 Claims, 9 Drawing Sheets

MODULAR, PORTABLE COLD ROOM STORAGE SYSTEM

CROSS-REFERENCE TO RELATED APPLICATIONS

This application claims priority of U.S. Provisional Application Ser. No. 62/889,793, filed on Aug. 21, 2019, entitled "MODULAR, PORTABLE COLD ROOM STORAGE SYSTEM," which is hereby incorporated herein by reference in its entirety.

TECHNICAL FIELD

The present invention relates to a portable cold room storage system that includes at least one cold room storage. More particularly, the present invention relates to modular, portable cold room storage systems that may be deployed practically anywhere in the world with limited or no supporting infrastructure.

BACKGROUND

About 1.3 Billion tons of food is wasted or lost each year. This represents 340 pounds of food lost or wasted for every person on the planet. Perfectly consumable food that either spoils or gets thrown away could feed 1.6 billion more people each year. The retail value of lost and wasted food costs the global economy more than the combined 2015 profits of the Fortune 500.

Loss occurs at the front of the food chain—when food rots in fields, or is lost as a result of poor transportation networks, or spoils in markets that lack proper storage and preservation equipment and practices.

What is needed then is a modular, portable cold room system that provides reliable cool or cold room storage that may be deployed practically anywhere in the world. Such a modular, portable cold room storage system, if installed, for example, near fields where food is grown, would dramatically reduce the amount of food waste, directly addressing the problems described above.

SUMMARY

These and others advantages may be provided by, for example, a portable cold room storage system which includes a cold or cool room capable of refrigerator temperature, one or more power sources to generate energy, a battery storage to store the energy generated by the one or more power sources and to supply the energy to the cold or cool room to maintain the refrigerator temperature, electronics enclosure including electronic components and a monitoring and control unit that has a network capability to be coupled to a central control unit, and a racking system to mount the one or more power sources. The one or more power sources may include a portable solar array. The monitoring and control unit may monitor state of the battery storage including state of health and state of charge, state of the one or more power sources including output voltage and current, and state of the cold or cool room including temperature. The monitoring and control unit may transmit results of the monitoring to the central control unit.

These and others advantages may be also provided by, for example, a cold room storage network system to monitor and control remotely deployed portable storage systems. The cold room storage network system includes one or more portable cold room storage systems and a central control unit coupled to the one or more portable cold room storage systems via the network capability of the monitoring and control unit of each portable cold room storage system. The central control unit may communicate with the monitoring and control units of the portable cold room storage systems via one or more selected from a group consisting of a network connection of mobile cellular networks, hardwired network connections, and WiFi. The central control unit may receive results of the monitoring which are transmitted from the monitoring and control units of the portable cold room storage systems. The central control unit may generate warning messages when at least one failure is detected from the results of the monitoring.

BRIEF DESCRIPTION OF THE DRAWINGS

Embodiments of the present invention are illustrated by way of example, and not limitation, in the accompanying figures in which like references denote similar elements, and in which.

DETAILED DESCRIPTION

Figure 1A:
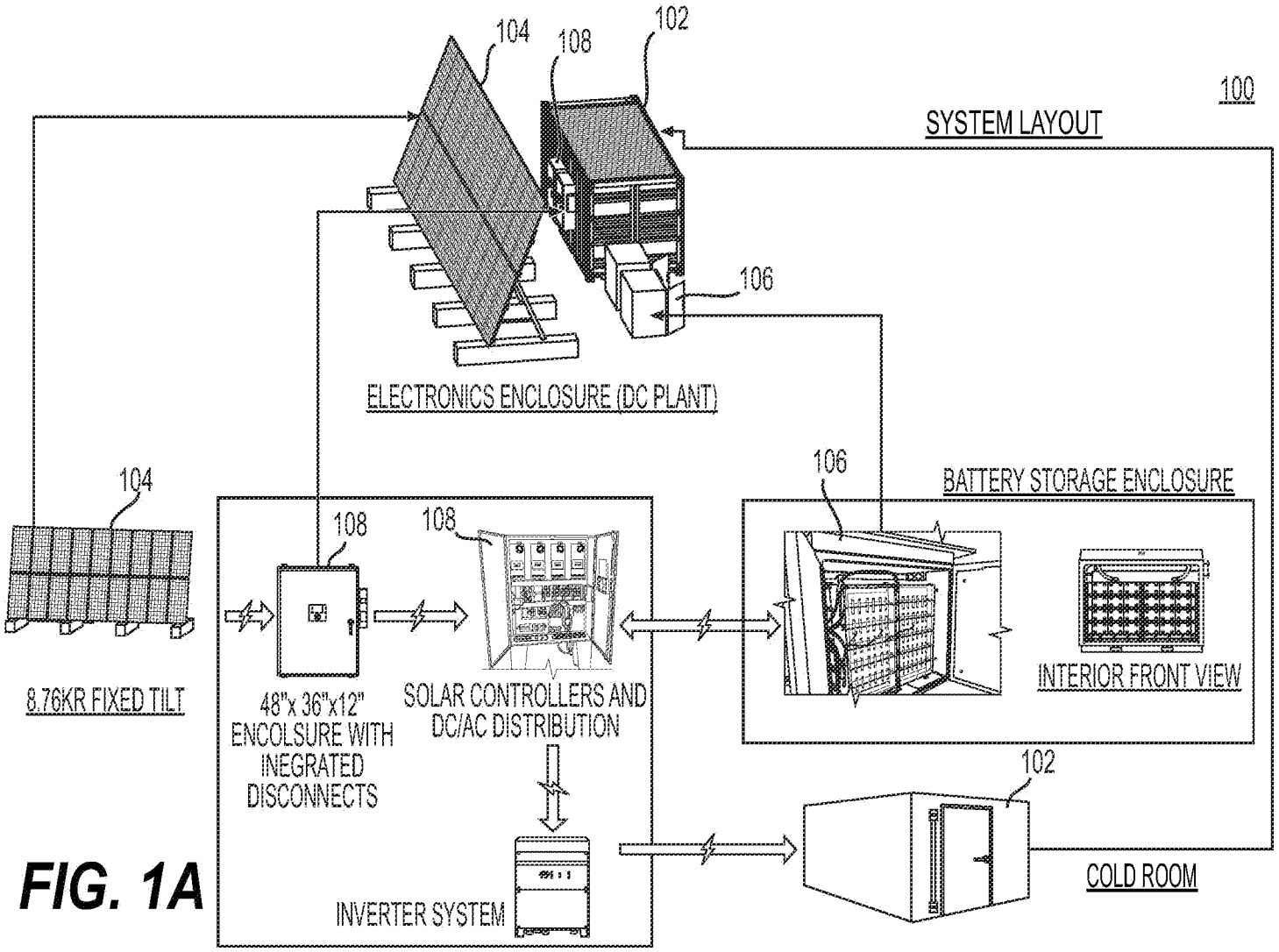
FIGS. 1A-1B show diagrams of a portable cold room storage system in accordance with an embodiment of the present invention.

In this section, some embodiments of the invention will be described more fully with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments. Parts that are the same or similar in the drawings have the same numbers and descriptions are usually not repeated.

Embodiments of the present invention provides modular, portable cold room storage system that may be deployed practically anywhere in the world with limited or no supporting infrastructure. Embodiments of the present invention further provides a cold room storage network system that includes a central control unit and one or more portable cold room storage systems which are connected to the central control unit via networking capabilities.

Figure 1B:
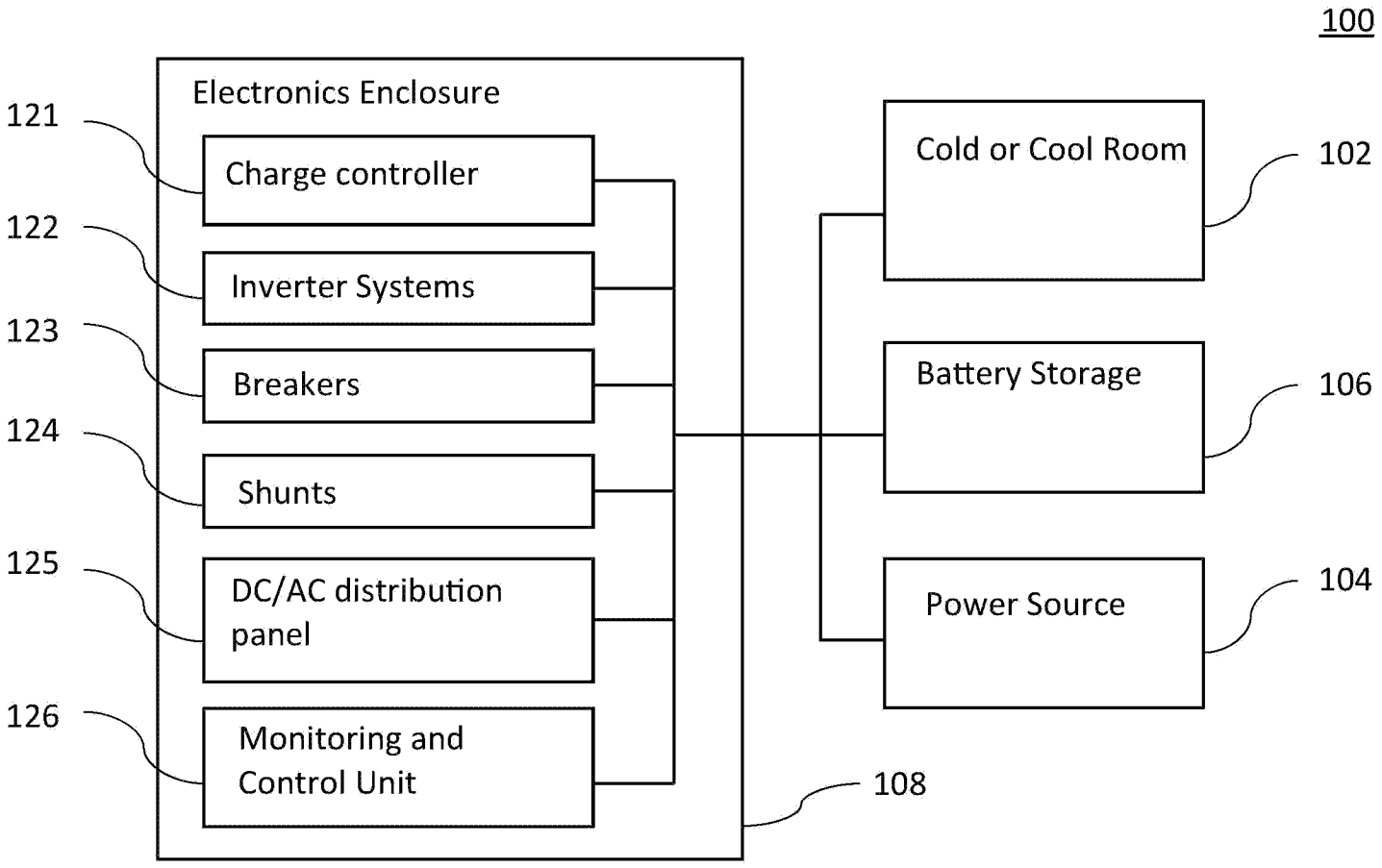

With reference to FIGS. 1A-1B, shown is a portable cold room storage system 100 in accordance with an embodiment of the present invention. As shown in FIGS. 1A-1B, portable cold room storage system 100 includes a cold or cool room 102, a power source 104, battery storage 106, and an electronics enclosure 108. Cold or cool room 102 may be a pre-fabricated cold or cool room that is built to withstand and operate in a variety of environmental conditions. It may include an exterior capable of withstanding all-weather conditions. Cold or cool room 102 may be a variety of sizes and shapes to best fit the storage needs of system 100 deployment. A typical cold or cool room 102 may be, for example, about 94 inches wide by about 117 inches long and 93 inches tall externally, and have internal dimensions of about 85 inches wide, 108 inches long and 86 inches tall. A typical cold or cool room 102 may include a power supply, for example, operating at 220 Volts, 60 Hertz, 1 Phase, and 30 Amps. Interior of cold or cool room 102 may include an internal light, racks, temperature control, a non-slip floor, a self-closing, and a lockable door with an internal glow-in-the-dark safety handle (not shown). Cold or cool room 102 is capable of maintaining refrigerator or freezer temperatures, and may include a ramp and be lift-able with a fork-lift. Cold or cool room 102 preferably includes a 240 Vac single compressor unit with a 777 AH/day load to maintain the refrigerator or freezer temperature.

Power source 104 may be a portable solar array. Solar array 104 may be a fixed-tilt, ballasted solar array. In the example shown in FIG. 1, solar array 104 is an 8.76 kW array that includes twenty-four (24), 365 W modules or panels and is DC-coupled. Power source 104 chosen should be relatively low-maintenance and high-reliability and capable of producing consistent power. Coupled with battery storage 106, power source 104 should provide power for cold or cool room 102 in most environments and conditions.

With continuing reference to FIGS. 1A-1B, battery storage 106 includes one or more enclosures containing stacks of rechargeable batteries. For example, battery storage 106 may include two parallel stacks of advanced lead acid batteries. The battery storage 106 may include lithium-ion battery stacks. Battery storage 106 ideally is capable of storing energy generated by power source 104 and supplying the energy to the cold or cool room 102 to power the cold or cool room 102 to maintain the refrigerator or freezer temperature. In an embodiment, battery storage parallel stacks of batteries may provide −48 Vdc, 4100 Ah, and up to three (3) days of autonomy. Battery stacks 106 may be passively cooled and contained within an insulated enclosure. Preferably the battery stacks 106 are skid mounted for ease of installation.

Electronics enclosure 108 acts as a DC power plant and control unit for system 100. The electronics enclosure 108 may include electronic components which may include solar charge controllers 121, inverter systems 122, breakers 123, shunts 124, DC/AC distribution panel 125, and a system monitoring and control unit 126. The system monitoring and control unit 126 may be remotely accessed via a network connection of mobile cellular networks, hardwired network connections, and/or WiFi. This provides the capability for remote monitoring and control of the system 100, enabling a remote operator to confirm maintenance of the system 100 and to instruct local maintenance and trouble-shooting when necessary. Invertor systems 121 may include a 48 Vdc to 240 Vac power invertor/conversion unit capable of providing 500 W. Electronics enclosure 108 may include two or more such invertor systems 121. The electronics enclosure 108 may enclose all of the above components in an enclosure with a lockable door and integrated disconnects. Electronics enclosure 108 may be a variety of sizes; the example shown is about 48 inches tall by 36 inches wide and 12 inches deep.

Portable cold room storage system 100 is capable of providing cool or cold storage (e.g., refrigeration or freezer storage) in a variety of environments throughout the world. It is modular, in that multiple cold or cold rooms may be linked together and controlled by the same control units such as central control unit 140 (shown in FIG. 1C). Remote monitoring and control enables consistent operation and maintenance, regardless of where the cold or cool rooms are deployed. System components reduce maintenance needed and enable low-skilled labor to perform necessary maintenance tasks.

Figure 1C:
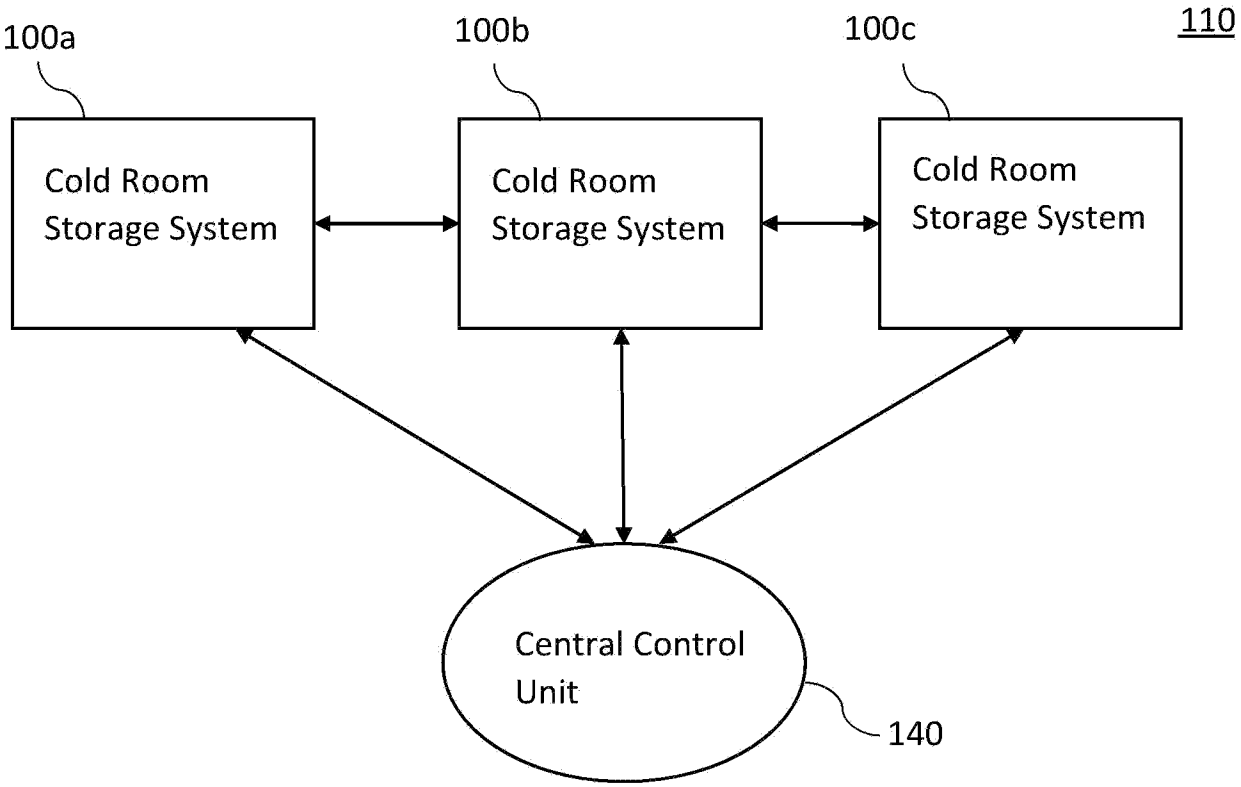
FIG. 1C shows a diagram of a cold room storage network system that includes a central control unit and one or more portable cold room storage systems.
Figure 1E:
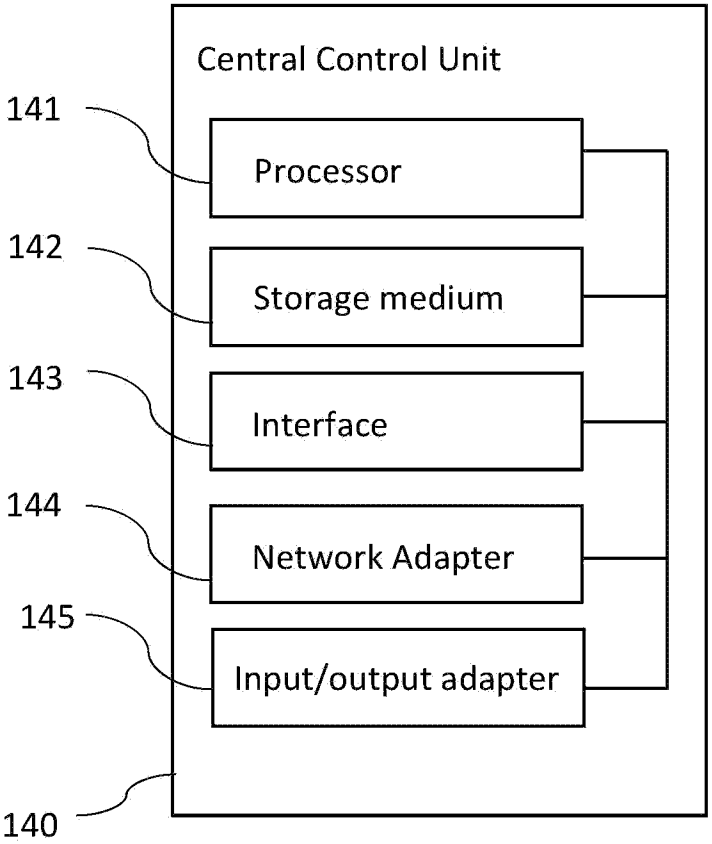
FIGS. 1D-1E show diagrams illustrating elements of monitoring and control unit of portable cold room storage system, and elements of the central control unit, respectively.
Figure 1D:
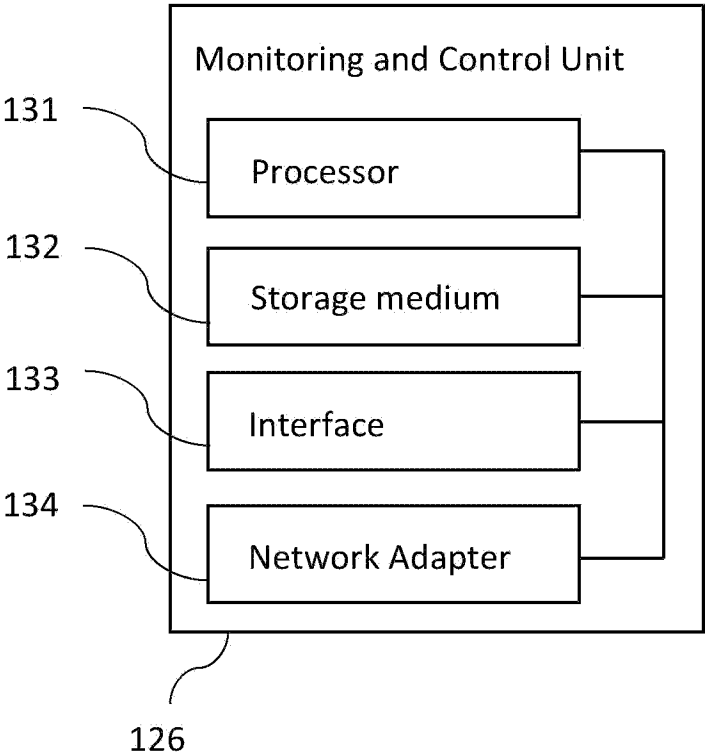

As shown in FIG. 1B, the monitoring and control unit 126 is coupled to the cold or cool room 102, a power source 104, and battery storage 106 via interface 133 (shown in FIG. 1D). The monitoring and control unit 126 may monitor state of the battery storage 106 such as state of health and state of charge of the battery stacks, output voltage and current from the battery stacks in the battery storage 106. The monitoring and control unit 126 may monitor state of the one or more power sources 104 such as output voltage and output current from the power sources 104. The monitoring and control unit 126 may monitor state of the cold or cool room 102 such as temperature of the interior of the cold or cool room 102. The monitoring and control unit 126 may transmits results of the monitoring to the central control unit 140 (shown in FIG. 1C). The central control unit 140 receives the results from the monitoring and control unit 126 of each portable cold room storage system 100, and may examine the results to check if there is any failures or abnormal conditions in the portable cold room storage system 100. For example, state of health of the battery stack in the battery storage 106 is not in a predetermined range, the central control unit 140 may generate warning messages, and the warning messages may be sent to a remote operator. The remote operator may examine the portable cold room storage system 100 based the warning messages.

With reference to FIG. 1C, shown is a diagram of a cold room storage network system 110 that includes a central control unit 140 and portable cold room storage systems 100*a*-100*c* which are deployed remotely. For the description purpose, FIG. 1C shows only three portable cold room storage systems, but the number of portable cold room storage systems is not limited to three. The central control unit 140 communicates with the monitoring and control unit 126 of each portable cold room storage system 100 via a network connection of mobile cellular networks, hardwired network connections, and/or WiFi.

With reference to FIGS. 1D-1E, shown are diagrams showing elements of the monitoring and control unit 126 of portable cold room storage system 100 and elements of the central control unit 140. The monitoring and control unit 126 may include at least one non-transitory storage medium 132 to store executable instructions and at least one processor 131 to execute the executable instructions that cause the at least one processor 131 to perform operations, for example, to monitor state of the battery storage 106, state of the one or more power sources 104 and state of the cold or cool room 102, to collect information, and transmit the information to the central control unit 140. The monitoring and control unit 126 includes network adapter 134 to communicate with the central control unit 140, and may further include interface 133 to communicate with the cold or cool room 102, power sources 104, and the battery storage 106.

The central control unit 140 may include at least one non-transitory storage medium 142 to store executable instructions and at least one processor 141 to execute the executable instructions that cause the at least one processor 141 to perform operations to receive results from the coupled portable cold room storage systems 100, to examine the results from portable cold room storage systems 100, and to determine any abnormal conditions of the portable cold room storage systems 100. The central control unit 140 may further include interface 143 to communicate with operators or users, input/output adapter 145 to communicate with other external devices, and network adapter 144 to communicate with the portable cold room storage systems 100 and other external network systems.

With respect to FIGS. 2-4C, an improved modular, portable cold room storage system 100 includes an improved solar panel racking system 200 that will provide solar power for the cold room storage system. The improved solar panel racking system 200 includes a ground mount solar racking structure. Modular units of the solar panel racking system 200 assemble rapidly while onsite and with minimal, non-skilled labor. No concrete or pile driving equipment is required and only common hand-held tools are used.

Figure 2:
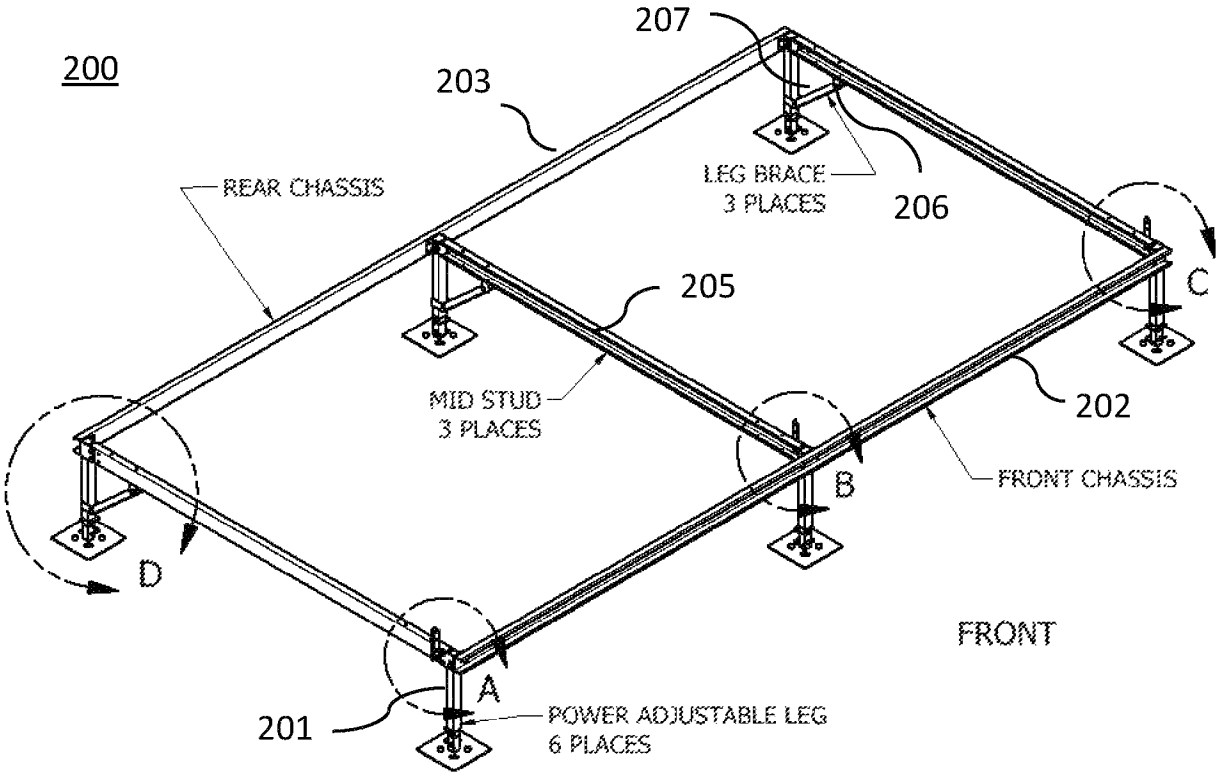
FIG. 2 shows a chassis of a solar panel racking system in accordance with an embodiment of the present invention.

FIG. 2 shows a chassis of the solar panel racking system. The chassis is easily assembled and completed using modular units. The units include power adjustable legs 201, a front chassis 202 and a rear chassis 203, one or more mid studs 205 that connect the front chassis 202 to the rear chassis 203, leg braces 206, leg brace brackets 207, and back brace brackets 208 (shown in FIG. 3). The power adjustable legs 201 work independent of each other so units can be installed on uneven terrain.

Figure 3:
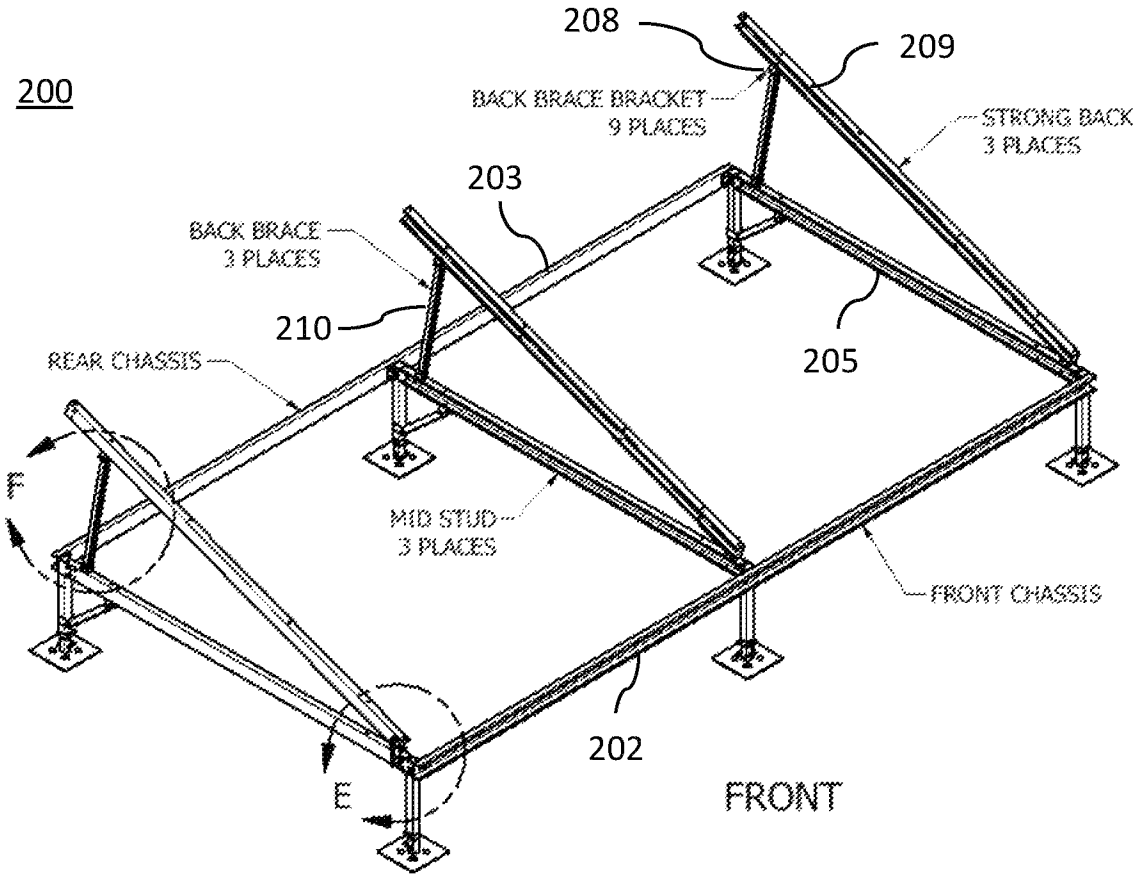
FIG. 3 shows strong backs and back braces mounted on the solar panel racking system in accordance with an embodiment of the present invention.

FIG. 3 shows strong backs and back braces mounted on the solar panel racking system 200. The strong back 209 is placed in line with the mid stud 205. The back brace 210 is installed on top of the mid stud 205 and on bottom of the strong back 209.

Figure 4A:
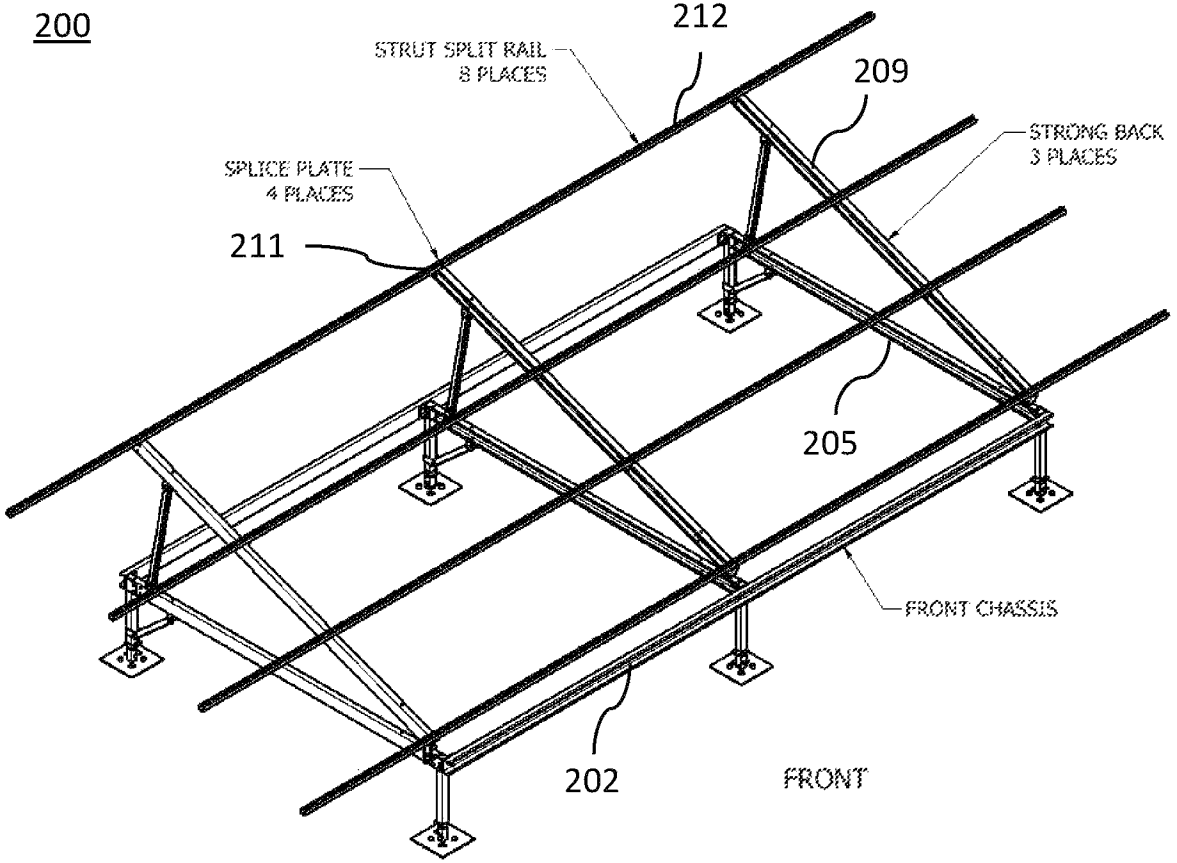
FIGS. 4A-4C show strut split rails mounted on the strong backs of the solar panel racking system in accordance with an embodiment of the present invention.
Figure 4C:
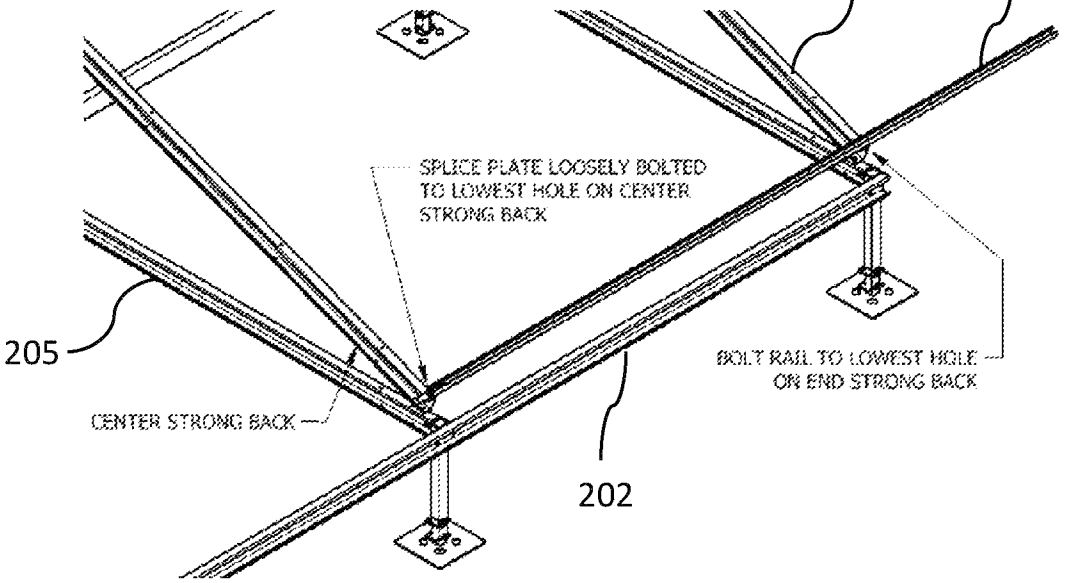
Figure 4B:
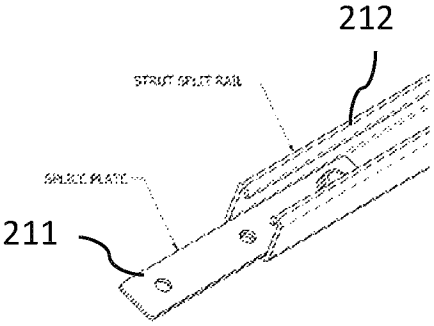

FIG. 4A shows strut split rails mounted on the strong backs of the solar panel racking system 200. A splice plate 211 is inserted into one of strut split rails 212, and the strut split rails 212 are mounted on the strong back 209. FIG. 4B shows the structure of the strut split rail 212 and the splice plate 211 coupled to the strut split rail 212. FIG. 4C shows a structure in which the strut split rail 212 is placed on the lower end of the strong back 209. The splice plate 211 is loosely bolted to the lowest hole on the top of the center strong back 209. Then, the other end of the strut split rail 212 is bolted to the end strong back 209. Solar panel may be mounted on the strut split rails 212.

Figure 5:
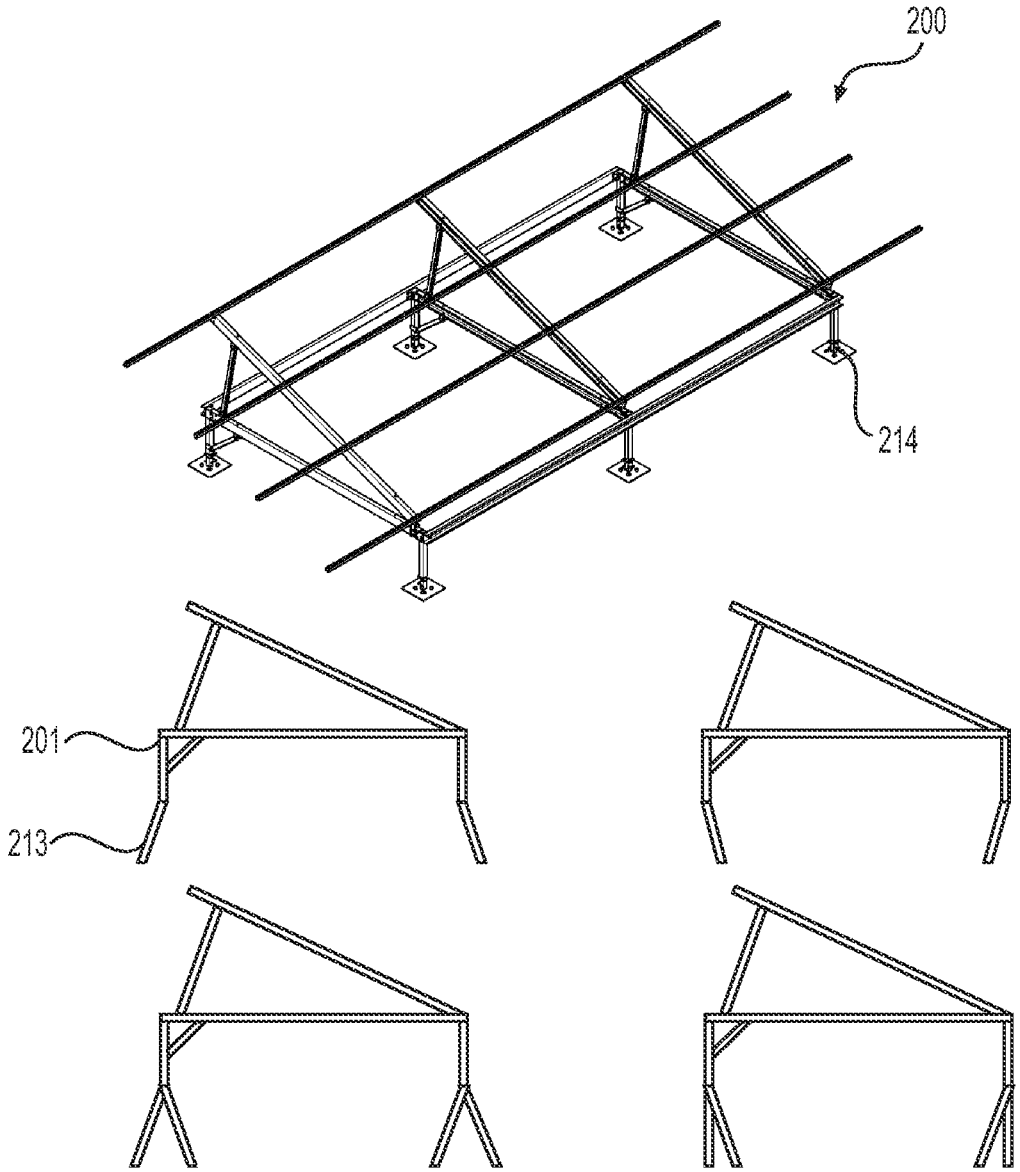
FIG. 5 shows configurations of the earth anchor lines in accordance with an embodiment of the present invention.

With reference to FIG. 5, shown is configurations of the earth anchor lines 214. The improvement utilizes earth penetrating earth anchors 213. Earth anchor 213 of the present invention have been proven and tested in a variety of applications of the portable cold room storage systems. Using this earth anchor technology allows the installation team to secure the solar array units to the ground and test for resistance to wind uploads in real time soil conditions eliminating the need for geotechnical soils reports or impact studies. The improved solar ground mount system allows the arrays to become portable meaning they can be moved, as needed.

Several embodiments of the present invention are specifically illustrated and/or described herein. However, it will be appreciated that modifications and variations of the present invention are covered by the above teachings without departing from the spirit and intended scope of the invention.

What is claimed is:

1. A modular deployable cold room storage system, comprising:

a cold or cool room capable of refrigerator temperature;

one or more power sources to generate energy;

a battery storage to store the energy generated by the one or more power sources and to supply the energy to the cold or cool room to maintain the refrigerator temperature;

electronics enclosure including electronic components and a computer device that includes at least one processor, a non-transitory storage medium, an interface and a network adapter that has a network capability to couple the computer device to a central computer device that includes at least one processor, a non-transitory storage medium, an interface, a network adapter and an input/output adapter; and a racking system to mount the one or more power sources, wherein the racking system is mounted on a ground.

2. The modular deployable cold room storage system of claim 1 wherein the one or more power sources include a deployable solar array.

3. The modular deployable cold room storage system of claim 1 wherein the battery storage includes one or more battery stacks that are skid mounted.

4. The modular deployable cold room storage system of claim 1 wherein the electronic components include charge controllers, inverter systems, breakers, shunts, and a DC/AC distribution panel.

5. The modular deployable cold room storage system of claim 1 wherein the computer device is configured to be remotely accessed via one or more selected from a group consisting of a network connection of mobile cellular networks, hardwired network connections, and WiFi.

6. The modular deployable cold room storage system of claim 1 wherein the computer device is configured to monitor state of the battery storage including state of health and state of charge, state of the one or more power sources including output voltage and current, and state of the cold or cool room including temperature.

7. The modular deployable cold room storage system of claim 6 wherein the computer device is configured to transmit results of the monitoring to the central computer device.

8. The modular deployable cold room storage system of claim 1 where the racking system comprises:

a front chassis;

a rear chassis;

a plurality of mid studs that connect the front chassis to the rear chassis;

a plurality of strong backs placed in line with the mid studs and coupled to the front chassis;

a plurality of back braces that connect the mid studs to the strong backs; and a plurality of strut split rails mounted on the strong backs, wherein the strut split rails are arranged to cross the strong backs and are configured to support solar panels.

9. The modular deployable cold room storage system of claim 8 further comprising one or more earth anchors to mount the racking system on the ground.

10. The modular deployable cold room storage system of claim 9 wherein the racking system further comprises a plurality of adjustable legs attached to the front chassis and the rear chassis, and the earth anchors are coupled to the adjustable legs.

11. A cold room storage network system to monitor and control remotely deployed modular deployable storage systems, comprising:

one or more modular deployable cold room storage systems, each modular deployable cold room storage system comprising:

a cold or cool room capable of refrigerator temperature;

one or more power sources to generate energy;

a battery storage to store the energy generated by the one or more power sources and to supply the energy to the cold or cool room to maintain the refrigerator temperature;

electronics enclosure including electronic components and a computer device that includes at least one processor, a non-transitory storage medium, an interface and a network adapter that has a network capability; and a racking system to mount the one or more power sources, wherein the racking system is mounted on a ground; and a central computer device that includes at least one processor, a non-transitory storage medium, an interface, a network adapter and an input/output adapter, wherein the central computer device is coupled to the one or more modular deployable cold room storage systems via the network adapter of the computer device of each modular deployable cold room storage system.

12. The cold room storage network system of claim 11 wherein the one or more power sources include a deployable solar array.

13. The cold room storage network system of claim 11 wherein the electronic components include charge controllers, inverter systems, breakers, shunts, and a DC/AC distribution panel.

14. The cold room storage network system of claim 11 wherein the central computer device is configured to communicate with the computer devices of the modular deployable cold room storage systems via one or more selected from a group consisting of a network connection of mobile cellular networks, hardwired network connections, and WiFi.

15. The cold room storage network system of claim 11 wherein the computer device is configured to monitor state of the battery storage including state of health and state of charge, state of the one or more power sources including output voltage and current, and state of the cold or cool room including temperature.

16. The cold room storage network system of claim 15 wherein the central computer device is configured to receive results of the monitoring which are transmitted from the computer devices of the modular deployable cold room storage systems.

17. The cold room storage network system of claim 16 wherein the central computer device is configured to generate warning messages when at least one failure is detected from the results of the monitoring.

18. The cold room storage network system of claim 11 where the racking system comprises:

a front chassis;

a rear chassis;

a plurality of mid studs that connect the front chassis to the rear chassis;

a plurality of strong backs placed in line with the mid studs and coupled to the front chassis;

a plurality of back braces that connect the mid studs to the strong backs; and a plurality of strut split rails mounted on the strong backs, wherein the strut split rails are arranged to cross the strong backs and are configured to support solar panels.

19. The cold room storage network system of claim 18 further comprising one or more earth anchors to mount the racking system on the ground.

20. The cold room storage network system of claim 19 wherein the racking system further comprises a plurality of adjustable legs attached to the front chassis and the rear chassis, and the earth anchors are coupled to the adjustable legs.

* * * * *